United States Patent [19]

Samodovitz

[11] Patent Number: 4,557,228

[45] Date of Patent: Dec. 10, 1985

[54] PISTON AND SPRING POWERED ENGINE

[76] Inventor: Arthur J. Samodovitz, 1 Lakeshore Dr., Apt. A-4, Farmington, Conn. 06032

[21] Appl. No.: 533,935

[22] Filed: Sep. 20, 1983

Related U.S. Application Data

[63] Continuation-in-part of Ser. No. 335,864, Dec. 30, 1981, abandoned.

[51] Int. Cl.[4] ..... F02B 75/00

[52] U.S. Cl. ..... 123/78 E; 60/699; 74/592

[58] Field of Search ..... 123/48 R, 48 B, 78 R, 123/78 E, 78 F, 197 A; 60/699; 185/40 R, 11; 74/581, 589, 592

[56] References Cited

U.S. PATENT DOCUMENTS

| | | | |
|---|---|---|---|
| 597,921 | 1/1898 | Strong | 60/699 |
| 676,247 | 6/1901 | Taylor | 60/699 |
| 1,431,617 | 10/1922 | Young | 123/197 A |
| 1,637,245 | 7/1927 | Scully | 123/78 E |
| 2,127,361 | 8/1938 | Hlasney | 123/48 B |
| 3,004,810 | 10/1961 | King | 123/78 E |

FOREIGN PATENT DOCUMENTS

| | | | |
|---|---|---|---|
| 113977 | 7/1982 | Japan | 60/669 |

*Primary Examiner*—Ira S. Lazarus

*Assistant Examiner*—R. S. Bailey

[57] ABSTRACT

The invention is an improved piston engine, either two stroke or four stroke. In one, two stroke, one cylinder embodiment, the improvement comprises two springs connecting between the piston and the base of the piston. These springs are relatively relaxed when the crank is at top dead center. Then during the power/intake stroke, some of the fuel's energy is delivered to the crankshaft and some is used to compress the springs. The stored energy in the springs is delivered to the crankshaft during the exhaust/compression stroke while the springs return to their relatively relaxed condition. As a result, energy is delivered to the crankshaft during both strokes of the cycle, and the engine runs smooth.

In one, four stroke, two cylinder embodiment, each cylinder has springs as described above, the cranks of each cylinder are aligned, and the cam sets one cylinder in the power stroke while the other is in the intake stroke. As a result, the engine runs smooth because energy is delivered to the crankshaft during all four strokes of the cycle, during two of the strokes by the burning fuel and during the other two by the release of energy in the springs. In both embodiments, a heavy crankshaft is not needed because of the more uniform power delivery.

14 Claims, 8 Drawing Figures

PISTON AND SPRING POWERED ENGINE

This is a continuation in part of the "Piston to Spring Power Engine", Ser. No. 335,864, filed 12/30/81, now abandoned.

BACKGROUND OF THE INVENTION

1. Field

The invention relates generally to internal combustion engines, and more particularly to a piston engine which runs smooth because energy is delivered to its crankshaft and stored in springs during the power stroke, and energy is delivered to the crankshaft during the exhaust stroke by the release of the spring's energy.

2. Description of the Prior Art

A standard four stroke, piston engine utilizes intake, compression, power, and exhaust strokes, and delivers power to the crankshaft during the power stroke of each cylinder. Therefore, in a one cylinder, four stroke engine, power is delivered to the crankshaft only one fourth of the time. In most typical, two cylinder, four stroke engines, the cycles of each cylinder are phased apart so that the power strokes of each cylinder occur at different times. As a result, power is delivered to the crankshaft only half of the time. In a conventional one cylinder, two stroke engine, power is delivered to the crankshaft only half the time, during the power/intake stroke. Engine vibration results from this sporatic power delivery in the three engines described above as well as high frequency fluctuations in vehicle speed, acceleration during the power strokes, and deceleration during the other strokes due to the load friction, and other loss factors.

One conventional remedy is to use a heavy crankshaft which acts as a flywheel or a flywheel itself, which, by its inertia, tends to keep the crankshaft speed constant. However, there are at least three problems with this system. First, the weight of the crankshaft or flywheel causes excess gas consumption, and makes the vehicle less manageable if it is otherwise light weight such as a motorcycle, motorized bicycle, or lawn mower. Second, the flywheel/crankshaft is not totally effective in maintaining engine speed. Third, it does not prevent the relatively low frequency engine vibration at the frequency of the crankshaft rotation in a two cylinder, four stroke engine or in a one cylinder, two stroke engine due to the sporatic power delivery to the crankshaft.

Another remedy is to build the engine with as many cylinders as strokes, and sequence the power strokes from each cylinder to provide one power stroke during each stroke. This system provides a more uniform power delivery to the crankshaft and so, less, low frequency vibrations and fluctuations in speed, but it is costly, heavy, and gas consumptive. Note that one cylincer, two stroke engines have less of a problem than one cylinder, four stroke engines because this two stroke engine has a power stroke during half of the cycle instead of one fourth in the four stroke.

SUMMARY OF THE INVENTION

It is a first object of the invention to provide a smooth running piston engine with less, low frequency vibrations and vehicle speed fluctuations.

It is a second object of the invention to make a piston engine which runs smoothly with only a lightweight crankshaft.

It is a third object of the invention to provide a smooth running piston engine with less cylinders than its number of strokes per cycle.

To satisfy these objects and others, there are provided one, two, or more springs connected between the piston and the crankshaft side of each cylinder or between the piston and some other point. These springs are compressed or stretched as the case may be to store energy released by the burning gases during the power stroke of their respective cylinders. Some of the energy released by the burning gases also works to drive the crankshaft during the power stroke. Then, during the exhaust stroke, the springs deliver their stored energy to the crankshaft. Also, during the intake stroke, energy is stored in the springs and this energy is delivered to the crankshaft during the next compression stroke. As a result, a two cylinder, four stroke engine phased so that when one cylinder is in the power stroke, the other is in the intake stroke, can provide net energy delivered to the crankshaft during each stroke. Also, in a one cylinder, two stroke engine, net energy is delivered to the crankshaft during both strokes, the power/intake stroke and the exhaust/compression stroke. As a result, low frequency vibrations in the engine and low frequency fluctuations in speed are reduced, and the engine runs smoother.

BRIEF DESCRIPTION OF THE DRAWINGS

FIG. 1(*b*) shows a top view of the base of the cylinder of FIG. 1(*a*), an arrow shows the back and forth motion of the connecting rod, and circles show where the springs attach.

DETAILED DESCRIPTION OF THE FIRST EMBODIMENT

Figure 1A:
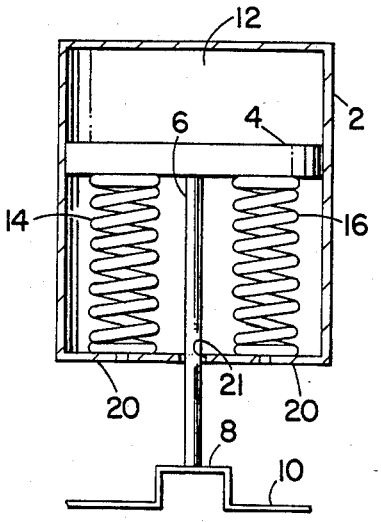
FIG. 1(*a*) shows a schematic diagram of major parts of a one cylinder unit of the first embodiment of the invention.
Figure 1B:
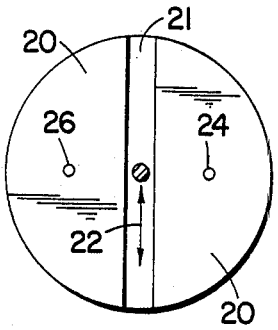

The first embodiment is a two cylinder, four stroke piston engine, and one cylinder unit is shown in FIG. 1(*a*). This engine can be used in a motorcycle, lawnmower, or any other device which uses a conventional two cylinder, four stroke piston engine.

The top and vertical sides of cylinder 2 are standard except the sides of the first embodiment may be elongated. Piston 4, connecting rod 6, crank 8, and crankshaft 10 are typical of conventional piston engines. In this cylinder of the four stroke engine, fuel enters the top chamber of cylinder 2, fuel chamber 12, although the valves are not shown. Then, the gaseous fuel is compressed in the standard way by the upward movement of crank 8, connecting rod 6, and piston 4. Then, the fuel is ignited in the usual way in the fuel chamber 12 by a spark plug, not shown. The burning fuel expands and pushes the piston downward, according to the orientation of FIG. 1, although the cylinder can be oriented in any direction and still work and connecting rod 6 also proceeds downward against crank 8. This power stroke drives crankshaft 10, and ultimately the load.

However, unlike typical four stroke piston engines, all of the work produced when the fuel burns does not go towards driving the crank. Instead, approximately one fourth of that work at moderate loads goes toward compressing springs 14 and 16, so that approximately as much work is delivered to the crank as is stored together in springs 14 and 16 and the analogous springs in the second cylinder the energy of the four springs being delivered to the crankshaft during the subsequent exhaust/compression stroke. Springs 14 and 16 and their analogous ones in the other cylinder were relayed or only slightly compressed or stretched when crank 8 was at top dead center, TDC, the end of the compression stroke, and are significantly compressed when the crank is at bottom dead center, BDC.

The cranks of both cylinders point in the same direction meaning that when one is at TDC the other is at TDC. Also, both cranks drive the same crankshaft 10. The cam and fuel intake and exhaust means are set us such that when one cylinder is in the power stroke, the other is in the intake stroke. As a result, when each cylinder delivers energy to crankshaft 10 by its power stroke, the springs in both cylinders are compressing and storing energy. Then, during the next stroke, the exhaust stroke for one cylinder and the compression stroke for the other cylinder, both pairs of springs deliver their energy to the crankshaft. This two stroke process is repeated as the two cylinders swap roles. Note that exhaust means such as valves exhaust the burnt gases during the exhaust stroke from fuel chamber 12.

To obtain the most constant energy delivery to the crankshaft, each pair of springs after one power/intake stroke should store approximately one half the energy delivered by one piston during one power stroke to the crankshaft during average loads for the following reasons: Both pairs store energy during the same two intervals, one cylinder's power stroke and other's intake stroke and vica versa, so, as much net energy goes to the crankshaft as into both pairs of springs during these two intervals. Then, both pairs deliver their energy to the crankshaft during the same two intervals, one's exhaust stroke and the other's compression stroke and vice versa, so, the same amount of energy will be delivered to the crankshaft during these two intervals as was delivered during the prior two. Thus, the springs work together to deliver approximately the same amount of energy to the crankshaft during the exhaust/compression strokes as is delivered by the piston and hot gas to the crankshaft during each power/intake stroke. Note that the springs store the same amount of energy during the power and intake strokes regardless of the load or the amount of fuel that is burned at any time, so, their stiffness should be such as to equalize their energy storage with the energy delivered to the crankshaft by one piston at an average or usual load.

Because of the energy delivery to the crankshaft by the springs during the non-power stroke intervals, there are only short periods when no energy is being input to the crankshaft, when the crank 8 is about TDC and BDC. As a result, the "coast" durations of crankshaft 10 are much less than in a standard two cylinder, four stroke engine when the crankshaft must coast half of the time. Therefore, a much lighter crankshaft can be used than in a standard two cylinder, four stroke engine. Also, the vibrations and fluctuations in engine speed are less and they have a higher frequency; as a result, they are less noticible and less offensive to the operator. In fact, this two cylinder, four stroke engine with the springs should run, at certain loads, as smooth as a standard, four cylinder, four stroke engine.

FIG. 1(*b*) shows a top view of the base 20 of cylinder 2 with a slot 21 to accomodate connecting rod 6. A slot is needed because back and forth motion of the rod results from its revolution about the axis of crankshaft 10. Arrow 22 shows the directions of this motion. Circles 24 and 26 show the location of the connection of springs 16 and 14, respectively, to base 20. Two springs are used instead of one in order to balance the force upon the piston 4. If only one spring were used, either 14 or 16, it would put a torque on the piston since neither spring is aligned along the axis of piston 4; this one spring per cylinder system would still store and deliver energy, and so, function in the same way as the two spring per cylinder system, but it would cause more friction on the piston edges.

In a slight variation of the first embodiment, base 20 is replaced by another base comprising two rods connecting from the front to the back of the bottom of cylinder 2 (according to the orientation of FIG. 1), on either side of the slot, and beneath springs 14 and 16. This variation has the advantage of being lighter in weight since this "rod" base weighs less than base 20 with its watermellon-slice shaped parts.

In another variation, the engine has two strokes per cycle only, and has only one cylinder unit. This cylinder unit is typical of two stroke engines with a conventional piston, cam, fuel intake means, exhaust means, connecting rod, crank, and crankshaft, although all these parts are not shown, plus the novel springs such as springs 14 and 16 situated as are springs 14 and 16 between the piston and the base of the piston. Also, the height of the cylinder may be greater to allow more length to the springs, the added length makes it easier to find a spring which can store the necessary energy. In a manner analogous to that described above for the four stroke engine, power is delivered to the crankshaft 10 and stored in said springs during the power/intake stroke, and power is delivered by the springs to the crankshaft during the exhaust/compression stroke; the springs were relaxed or only slightly compressed or stretched when the crank was at TDC and the springs were most compressed when the crank was at BDC. Also, the springs have a stiffness such that at moderate loads, approximately the same amount of energy is delivered to the crankshaft during the power/intake stroke as is stored in the springs during the same stroke. Thus, during the next exhaust/compression stroke, a like amount of energy is delivered to the crankshaft. As a result, this one cylinder, two stroke engine should run about as smooth as a conventional two cylinder, two stroke engine at a certain load corresponding to where the energy into the crankshaft during the power/intake stroke equals the energy into the crankshaft from the springs during the exhaust/compression stroke.

In another variation, springs 14 and 16 connect to piston 4 and base 20 (or substitute rod base) via vertical rods, nipples, or supports attaching to either end of said springs and to the piston or base.

In another variation of the first embodiment, the structure of FIG. 1 is the lone cylinder unit of a one cylinder, four stroke engine, it operates as does the first embodiment except, during the power stroke, the springs 14 and 16 store approximately the same amount of energy as is delivered to crankshaft 10 by the piston and burning gases under moderate load or a usual load. This variation does not provide as constant of an energy delivery to the crankshaft as does the two cylinder, four stroke engine or the one cylinder, two stroke engine because, during the intake stroke, energy is actually drawn from the crankshaft to compress the springs; during the other three strokes, energy is delivered to the crankshaft. But, this variation should lessen the low frequency vibration as compared to a standard one cylinder, four stroke engine operating at the same power output.

Some conventional fastening means secures springs 14 and 16 to piston 4 and base 20, as well as the other springs in subsequent embodiments to their points of attachment. Connecting rod 6 attaches to piston 4 by conventional pivoting means, and is rotatably mounted to crank 8.

DETAILED DESCRIPTION OF THE SECOND EMBODIMENT

Figure 2:
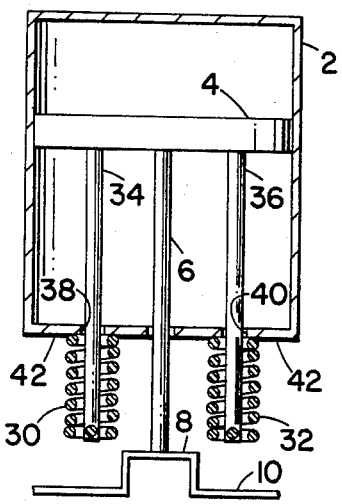
FIG. 2 shows a schematic diagram of major parts of a one cylinder unit of the second embodiment of the invention.

One cylinder unit of the second embodiment of the invention is shown in FIG. 2, and is similar in operation and structure to the first embodiment, and has similar applications and variations except that springs 30 and 32 attach between spring rods 34 and 36 respectively and the base 42 of the piston. As a result, springs 30 and 32 are relaxed when crank 8 is at TDC, and are most stretched when crank 8 is at BDC; springs 30 and 32 deliver their stored energy to crankshaft 10 during the same strokes as did springs 14 and 16 except springs 30 and 32 deliver their stored energy by relaxing from their stretched condition instead of relaxing from their compressed condition as did springs 14 and 16. Springs 30 and 32 have the advantage of being more accessable during replacement since they are in the crankcase (not shown).

Spring rods 34 and 36 move up and down through holes 38 and 40 in base 42. Springs 30 and 32 straddle holes 38 and 40 respectively and attach by rigid means to base 42. Base 42 is similar to base 20, except base 42 has the additional holes 38 and 40; rods can also be used.

To provide more length for springs 30 and 32, spring rods 34 and 36 can be elongated and can extend below crankshaft 10 (according to the orientation of FIG. 2). If so, rods 34 and 36 and their respective springs should be situated on opposite sides of crankshaft 10, one in fornt and one in back (according to the orientation of FIG. 2) so as to minimize torque on piston 4. The added length of the springs makes it less likely that their compression will permanently deform them; with the increased length, it is easier to provide springs which operate in their elastic region.

In a variation to the second embodiment, the spring rods are further extended downward and pass through holes in the bottom of the crankcase; the springs attach between the ends of their respective spring rods and the bottom of the crankcase. This arrangement provides much easier access to the springs during their replacement since the springs are outside the cylinder and the crankcase.

DETAILED DESCRIPTION OF THE THIRD EMBODIMENT

Figure 3:
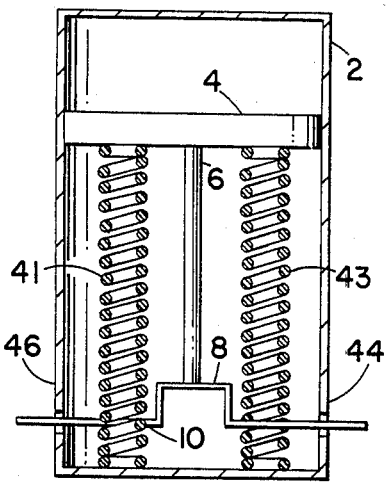
FIG. 3 shows a schematic diagram of major parts of a one cylinder unit of the third embodiment, and includes the crankcase.

One cylinder of the third embodiment is shown in FIG. 3, and is similar in structure and operation to the first embodiment and has similar variations and applications except energy storage springs 40 and 42 connect between the piston and the bottom of the crankcase 44. Spring 40 is situated in front of crankshaft 10, and spring 42 is situated in back of crankshaft 10 (according to the orientation of FIG. 3), and both springs are in the same plane as the axis of piston 4 to minimize torque on the piston. The attachment of the bottom of springs 40 and 42 to the bottom of the crankcase allows more length to these springs so that their compression is less likely to permanently deform the springs.

Portion 46 of crankcase 44 is where the crankcase can be expanded to accomodate an adjacent cylinder unit with another crank and an extended crankshaft 10.

DETAILED DESCRIPTION OF THE FOURTH EMBODIMENT

Figure 4:
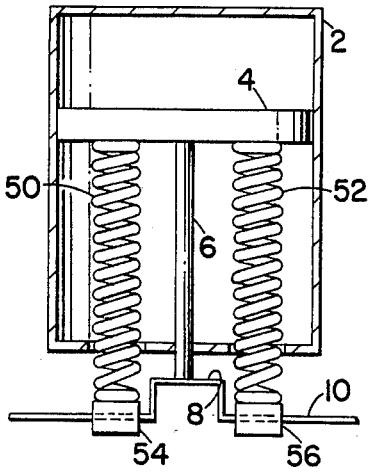
FIGS. 4–7 show schematic diagrams of major parts of a one cylinder unit of each of the fourth through seventh embodiments, respectively.

One cylinder unit of the fourth embodiment is shown in FIG. 4, and is similar in structure and operation to the first embodiment and has similar variations and applications except the energy storage springs 50 and 52 connect between piston 4 and crankshaft 10 by means of sleeves 54 and 56. Crankshaft 10 rotates will little friction within these sleeves because of ball bearings or oil or other conventional friction minimizing means within said sleeves. As in the first and third embodiments, springs 50 and 52 are relaxed or only slightly stretched or compressed when crank 8 is at TDC, and are most compressed when crank 8 is at BDC. The advantage of the fourth embodiment over the first is that the fourth allows more length for the energy storage springs. The disadvantage is the torque put on the springs by the rotation of the crankshaft despite the friction minimizing means within the sleeves 54 and 56.

DETAILED DESCRIPTION OF THE FIFTH EMBODIMENT

Figure 5:
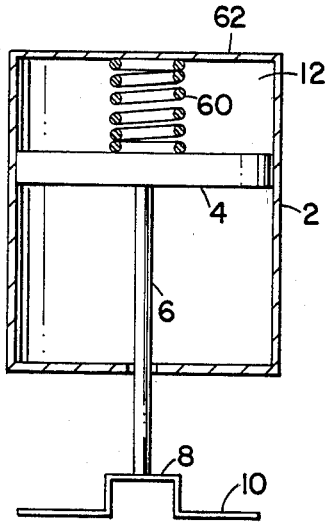

One cylinder unit of the fifth embodiment is shown in FIG. 5, and is similar in structure and operation to the first embodiment and has similar variations and applications except the energy storage spring 60 connects between the top of piston 4 and the top 62 of cylinder 2. Spring 60 is located in the fuel chamber 12, it is relaxed or only slightly compressed or stretched when crank 8 is at TDC, and it stores energy by stretching; the most stretched condition exists when crank 8 is at BDC. Since spring 60 is located on the axis of piston 4, only one spring is needed.

In a variation of the fifth embodiment, a spring rod attaches to the top of piston 4 and extends upward through a hole in cylinder top 62; the lone storage spring attaches between the top of this spring rod and the top of cylinder top 62. This spring is relaxed at TDC and compressed at BDC. If the "head" (for the valves) is located on top of cylinder 2, then this rod should also pass through the head, and the energy storage spring attaches between the top of this spring rod and the top of the head.

DETAILED DESCRIPTION OF THE SIXTH EMBODIMENT

Figure 6:
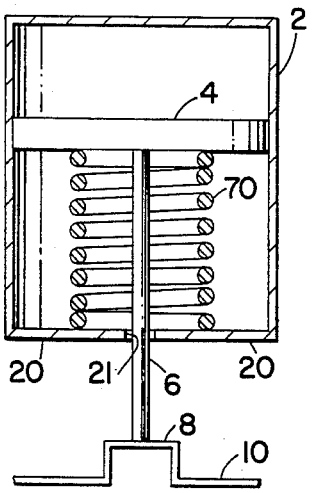

One cylinder unit of the sixth embodiment is shown in FIG. 6, and is similar in structure and operation to the first embodiment and has similar applications and variations except the storage spring 70 fits over connecting rod 6. The diameter of spring 70 must be large enough so that connecting rod 6 can move back and forth freely within slow 21. Spring 70 attaches between the bottom of piston 4 and the base 20 (or substitute base rods) of cylinder 2. Since spring 70 is situated along the axis of piston 4, no other balancing spring is needed.

DETAILED DESCRIPTION OF THE SEVENTH EMBODIMENT

Figure 7:
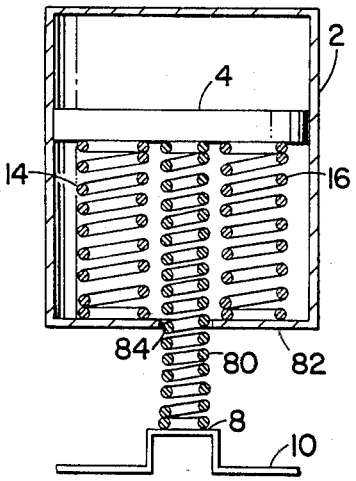

One cylinder unit of the seventh embodiment is shown in FIG. 7, and is similar in structure and operation to the first embodiment and has similar applications and variations except connecting rod 6 is replaced with connecting spring 80. Spring 80, like connecting rod 6 is rotably mounted to crank 8 by conventional means. The purpose of using the connecting spring 80 instead of the connecting rod is to allow more compression of energy storage springs 14 and 16 during heavy loads because during heavy loads much fuel burns and pushes down on piston 4 extra hard. As a result, connecting spring 80 compresses and allows piston 4 to move closer to base 20 than if connecting rod 6 were used, and energy storage springs compress more and store more energy. Then, during the exhaust stroke, more energy is delivered to crankshaft 10 by the springs, and the energy delivery during the power and exhaust strokes is better balanced (as well as the energy deliver during the other two strokes in a four stroke engine). See Wuerfel U.S. Pat. No. 4,111,164, Campbell U.S. Pat. No. 2,372,472, and the Swiss patent by Zala No. 570,548 for a discussion of the design and uses of this connecting spring.

In variations of the seventh embodiment, the Wuerfel, Campbell, and Zala connecting spring assemblies are utilized instead of spring 80 between piston 4 and crank 8. Those assemblies include an assortment of springs, sleeves with guide rods, resilient means, and dashpots to control the movement of the main spring. Spring 80 and said spring assemblies "connect" piston 4 to crank 8.

Base 82 is similar to base 20 of the first embodiment except slot 84 is wider than slot 21 to accomodate the diameter of spring 80 which is larger than the diameter of connecting rod 6.

I claim:

1. In a piston engine having a cylinder, means for introducing fuel into the cylinder, means for igniting said fuel, means for exhausting the burnt gases, a piston within the cylinder, a crank, a connecting rod pivotally connecting the piston to the crank, and a crankshaft, the improvement comprising:

resilient means for storing energy received from the pistion and burning gases during the outward movement of the pistion, and for delivering most of said stored energy to the crankshaft during the inward movement of the piston in a manner which drives the crankshaft in its existing direction of rotation, said resilient means comprising a spring connecting between the piston and a point stationary relative to the cylinder.

2. The piston engine of claim 1 wherein the cylinder has a base, and the spring connects between the piston and said base.

3. The piston engine of claim 2 wherein the resilient means further comprises a second spring connecting between the piston and said base, the springs connecting to said base on opposite sides of the connecting rod.

4. The piston engine of claim 2 wherein the spring surrounds the connecting rod and the diameter of the spring is large enough to allow the piston rod to oscillate within the spring without causing the spring to oscillate with it.

5. The piston engine of claim 1 further comprising a second rod, said second rod having one end connecting to the piston and extending outward, and wherein the cylinder has a base, and said spring connects between said base and the outer end of said second rod.

6. The piston engine of claim 5 further comprising a third rod, said third rod having one end connecting to the piston, and wherein said resilient means further comprises a second spring connecting between said base and the other end of said third rod.

7. The piston engine of claim 1 further comprising a crankcase, and wherein said resilient means comprises a spring connecting between the piston and the crankcase.

8. The piston engine of claim 7 wherein said resilient means further comprises a second spring connecting between the piston and the crankcase.

9. The piston engine of claim 1 wherein said spring means comprises a spring connecting between the piston and the crankshaft.

10. The piston engine of claim 9 wherein said spring means further comprises a second spring connecting between the piston and the crankshaft, the springs connecting to the crankshaft on opposite sides of the crank.

11. The piston engine of claim 1 wherein the cylinder has a top, and said spring means comprises a spring connecting between the piston and said top.

12. In a two cylinder, four stroke piston engine having power, exhaust, intake, and compression strokes, two cylinders, means for introducing fuel into each cylinder, means for igniting the fuel, means for exhausting the burnt gases, a piston within each cylinder, a crank for each cylinder, a connecting rod for each cylinder pivotally connecting the respective piston to the respective crank, and a common crankshaft, the improvement comprising:

resilient means for each cylinder for storing energy received from its piston and burining gases during the outward movement of said piston, and for delivery most of said stored energy to the crankshaft during the inward movement of said piston in a manner which drives the crankshaft in its existing direction of rotation, said resilient means for each cylinder comprising a spring connecting between the piston and a point stationary relative to the cylinders, and wherein both cranks point in substantially the same direction, and said means for introducing fuel into each cylinder, said means for igniting the fuel, and said means for exhausting the burnt gases set one cylinder in the power stroke while the other cylinder is in the intake stroke.

13. The piston engine of claim 12 wherein each cylinder has a base, and wherein said stationary point with respect to each cylinder is located on the base of each cylinder.

14. The piston engine of claim 12 further comprising a crankcase and wherein said stationary point with respect to each cylinder is located beneath each cylinder on the crankcase.

* * * * *